US008341838B2

(12) United States Patent
Low

(10) Patent No.: US 8,341,838 B2
(45) Date of Patent: Jan. 1, 2013

(54) METHOD OF INSTALLING A COAXIAL CABLE INTO AN ELECTRICAL CONNECTOR

(75) Inventor: David R. Low, Frankfort, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/951,466

(22) Filed: Nov. 22, 2010

(65) Prior Publication Data

US 2012/0124820 A1 May 24, 2012

(51) Int. Cl.
*H01R 43/00* (2006.01)

(52) U.S. Cl. ..... 29/857; 29/861; 29/862; 29/863

(58) Field of Classification Search ..... 29/857, 29/861, 862, 863
See application file for complete search history.

(56) References Cited

U.S. PATENT DOCUMENTS

| | | | | |
|---|---|---|---|---|
| 5,195,910 | A | 3/1993 | Enomoto et al. | |
| 5,624,278 | A | 4/1997 | Kuroda et al. | |
| 5,651,698 | A * | 7/1997 | Locati et al. | 439/578 |
| 5,756,972 | A | 5/1998 | Vranicar et al. | |
| 6,454,613 | B2 | 9/2002 | Valceschini | |
| 6,929,508 | B1 | 8/2005 | Holland | |
| 7,044,771 | B2 * | 5/2006 | Holliday | 439/491 |
| 7,329,049 | B2 * | 2/2008 | Meek et al. | 385/55 |
| 7,717,740 | B2 | 5/2010 | Zahnen et al. | |
| 2004/0185707 | A1 * | 9/2004 | Holliday | 439/491 |

FOREIGN PATENT DOCUMENTS

| | | |
|---|---|---|
| JP | 10-223296 | 8/1998 |
| JP | 2006-252806 | 9/2006 |

OTHER PUBLICATIONS

Kim, Sung Hee—International Search Report, counterpart international application: PCT/US2011/046055 issued Feb. 24, 2012 by KIPO, Seo-gu, Daejeon, Republic of Korea.

* cited by examiner

*Primary Examiner* — Carl Arbes
(74) *Attorney, Agent, or Firm* — Babcock IP, PLLC

(57) ABSTRACT

A coupling body for a coaxial connector is dimensioned to couple with connector body at a connector end. An inner body of the coupling body is provided with a bore dimensioned to receive the coaxial cable. The inner body is formed of transparent material partially covered in an opaque material. An uncovered portion of the inner body functions as a visual installation portal. Methods of installation include inserting the coaxial cable into the cable end of the bore of the inner body until a desired portion of a prepared end of the coaxial cable is visible.

7 Claims, 6 Drawing Sheets

METHOD OF INSTALLING A COAXIAL CABLE INTO AN ELECTRICAL CONNECTOR

BACKGROUND OF THE INVENTION

1. Field of the Invention

The invention relates to electrical connectors. More particularly, the invention relates to a lightweight and cost efficient electrical connector for a coaxial cable with a visual installation portal in the coupling body which provides feedback of correct installation to the user.

2. Description of Related Art

Installation errors may occur when a cable end is improperly inserted into an electrical connector, creating a less than optimal electro-mechanical interconnection, damaging the connector and/or cable. Visual installation feedback has been utilized in electrical connectors to ensure that a proper connection has been made and/or the desired insertion depth has been achieved when inserting the cable into the electrical connector. Prior visual installation feedback applied to electrical connectors typically required numerous additional parts and/or manufacturing operations, incurring significant additional expense. Examples in the art include open sections, which must be covered and sealed, and/or viewing windows made of transparent material, which must be sealed or bonded to the body of the connector. The corresponding sealing or bonding areas may create weak points susceptible to leakage and/or premature connector failure.

U.S. Pat. No. 7,717,740 discloses an electric power connector with a viewing window that is sealed or bonded to a separately formed insulating cover. Providing a window assembly as a separate piece, seated within a further element of the connector, may significantly complicate the manufacturing process and add additional costs. Also, the coupling area between these separate elements may create an area of potential structural weakness.

Competition in the coaxial cable connector market has focused attention on improving electrical/mechanical performance and minimization of overall costs, including material costs, manufacturing costs, training requirements for installation personnel, reduction of dedicated installation tooling and the total number of required installation steps and/or operations.

Therefore, it is an object of the invention to provide an electrical connector and method of manufacture that overcomes deficiencies in the prior art.

BRIEF DESCRIPTION OF THE DRAWINGS

The accompanying drawings, which are incorporated in and constitute a part of this specification, illustrate embodiments of the invention, together with a general description of the invention given above, and the detailed description of the embodiments given below, serve to explain the principles of the invention. Like reference numbers in the drawing figures refer to the same feature or element and may not be described in detail for every drawing figure in which they appear.

DETAILED DESCRIPTION

Figure 1:
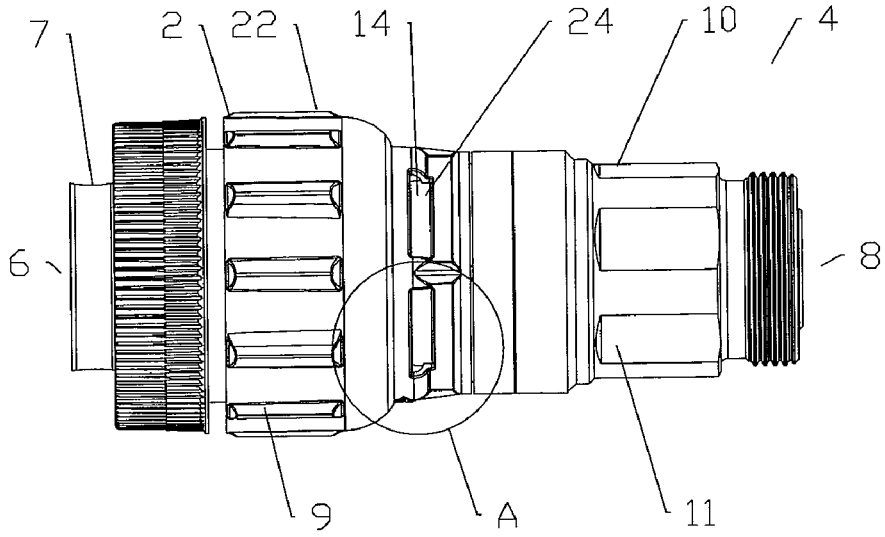
FIG. 1 is a schematic side view of an exemplary embodiment of a coaxial connector with installation feedback in which a good interconnection with the attached coaxial cable is indicated.

The inventor has recognized the difficulty of verifying that a coaxial cable has been correctly inserted into a coaxial connector to create a positive connector to cable interconnection. In particular, where the coaxial connector is an insertion coupling type coaxial connector, for example as disclosed in US Patent Application Publication No.: 2010-0112855, titled "Insertion Coupling Coaxial Connector" by Paynter et al, published May 6, 2010, hereby incorporated by reference in its entirety, because the insertion coupling type connector may be fully assembled prior to cable end insertion there is minimal feedback that insertion to the depth required for positive interconnection has been achieved. Absent insertion feedback, an installer may be led to believe that suitable insertion has occurred when in fact the coaxial cable has hung upon a coupling feature, such as the inner conductor contacting a side edge of an inner contact spring basket, rather than entering and fully seating against the bottom of the spring basket. Alternatively, even if correctly inserted to the proper depth, an installer unsure that proper insertion has been achieved may apply further excessive insertion force, resulting in damage to the connector and/or coaxial cable.

In an exemplary embodiment of a coupling body 2 for a coaxial connector 4, as shown in FIGS. 1-10, the coupling body 2 has a cable end 6 for insertion of the coaxial cable 7 and a connector end 8 for coupling with a connector body 10. One skilled in the art will appreciate that the cable end 6 and the connector end 8 are applied herein as identifiers for respective ends of both the overall assembly and also of discrete elements of the assembly described herein, to identify same and their respective interconnecting surfaces according to their alignment along a longitudinal axis of the coaxial connector 4 between a connector end 8 and a cable end 6.

Figure 6:
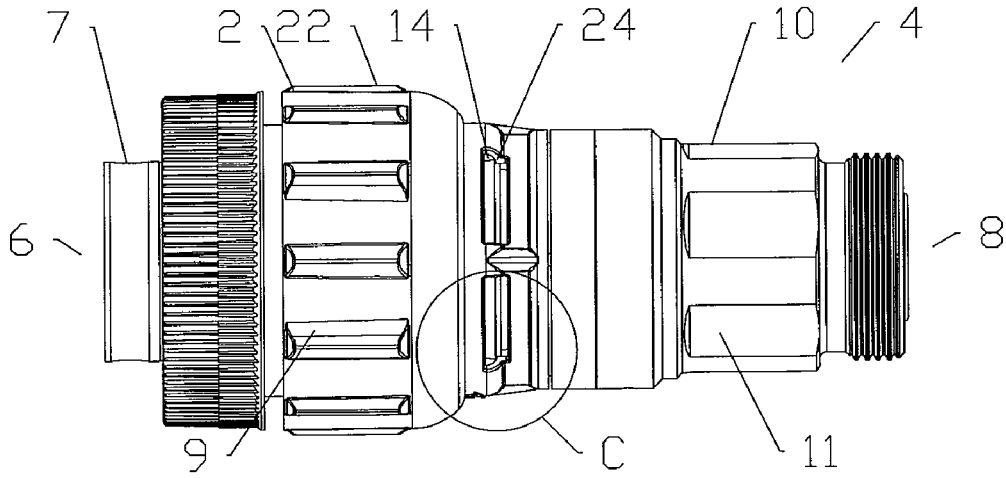
FIG. 6 is a schematic side view of the coaxial connector of FIG. 1 in which a bad interconnection with the attached coaxial cable is indicated.

As best shown in FIGS. 1 and 6, the coupling body 2 may be provided with protrusions 9 to facilitate gripping during installation. The connector body may be provided with tool flats 11 for mating with a tool to retain the connector body, for example while threading is performed with respect to an attaching connector interface.

The coupling body 2 may be configured to perform connector functions in concert with the connector body 10, such as electro-mechanical interconnection with an outer conductor 12 of a coaxial cable 7. Details of these functions and the associated coupling body 2 structures are well known in the art, dependent upon the type of coaxial connector 4 the coupling body 2 is applied to, and as such are not further described in detail herein.

Figure 4:
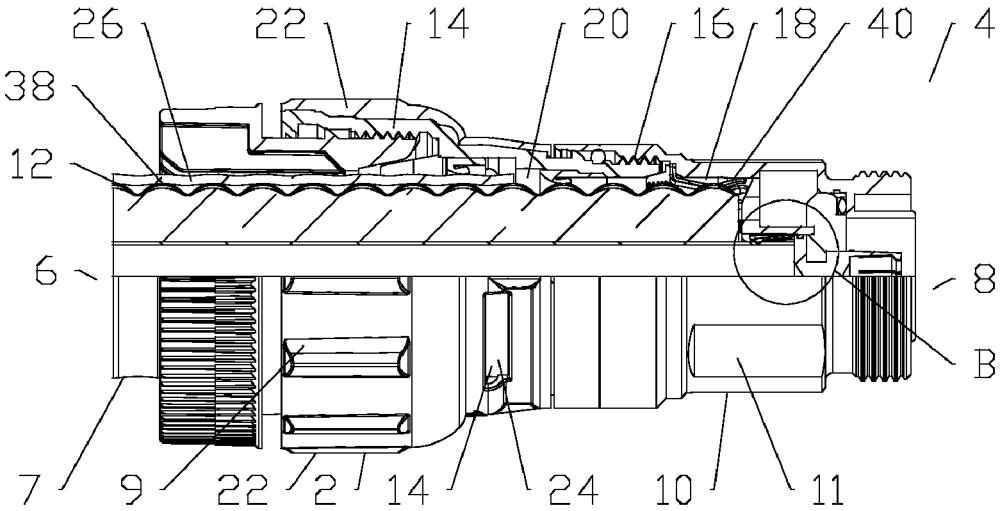
FIG. 4 is a schematic partial cut-away side view of the coaxial connector of FIG. 1, taken along line E-E of FIG. 3.
Figure 9:
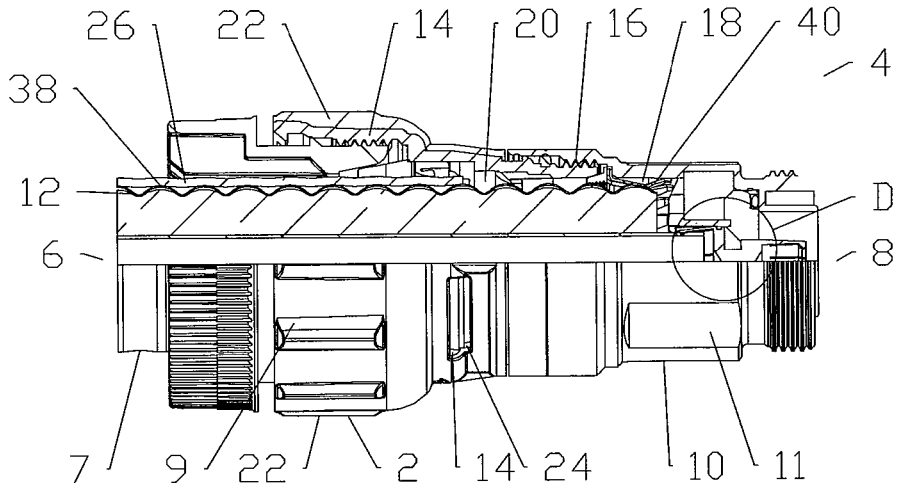
FIG. 9 is a schematic cut-away side view of the coaxial connector of FIG. 8, taken along line F-F.

As best shown in FIGS. 4 and 9 an outer diameter of an inner body 14 of the coupling body 2 at the connector end 8 of the coupling body 2 may be provided with a thread 16. Similarly, the connector body 10 may be provided with a corresponding thread 16 on an inner diameter of the connector body bore 18. The inner body 14 can thus be threadably attached to the connector body 10. Alternatively, the coupling between the coupling body 2 and the connector body 10 may be via a snap interlock, such as tab into groove, or thread positions may be exchanged, such that the connector end 8 of the inner body 14 threads over the cable end 6 of the connector body 10, rather than into it.

Figure 2:
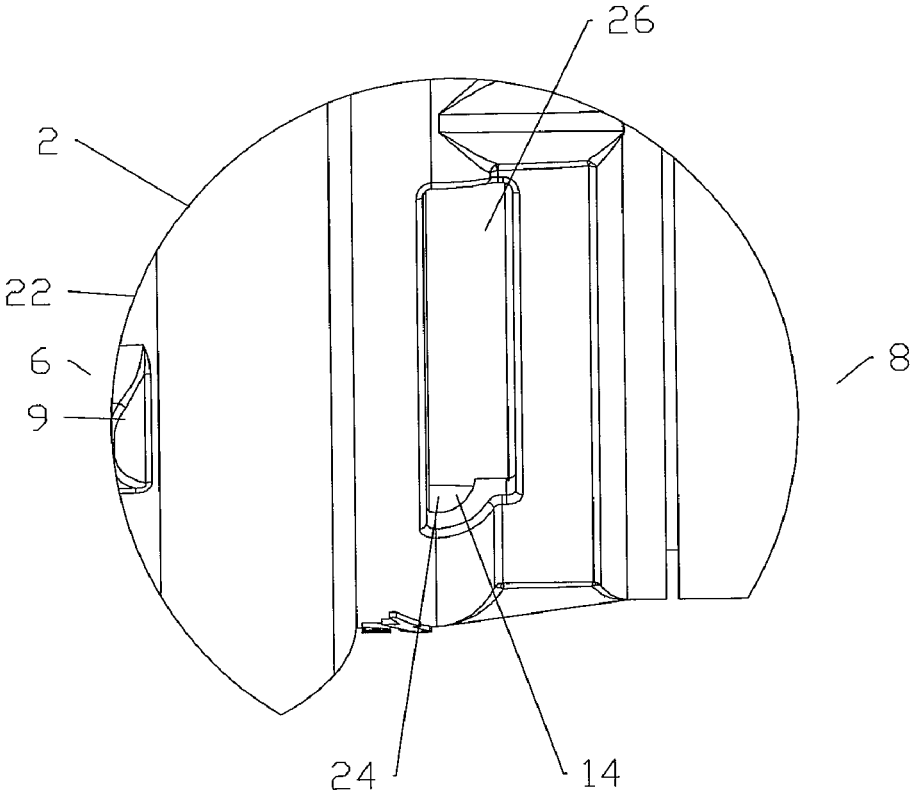
FIG. 2 is a close-up view of area A of FIG. 1.
Figure 3:
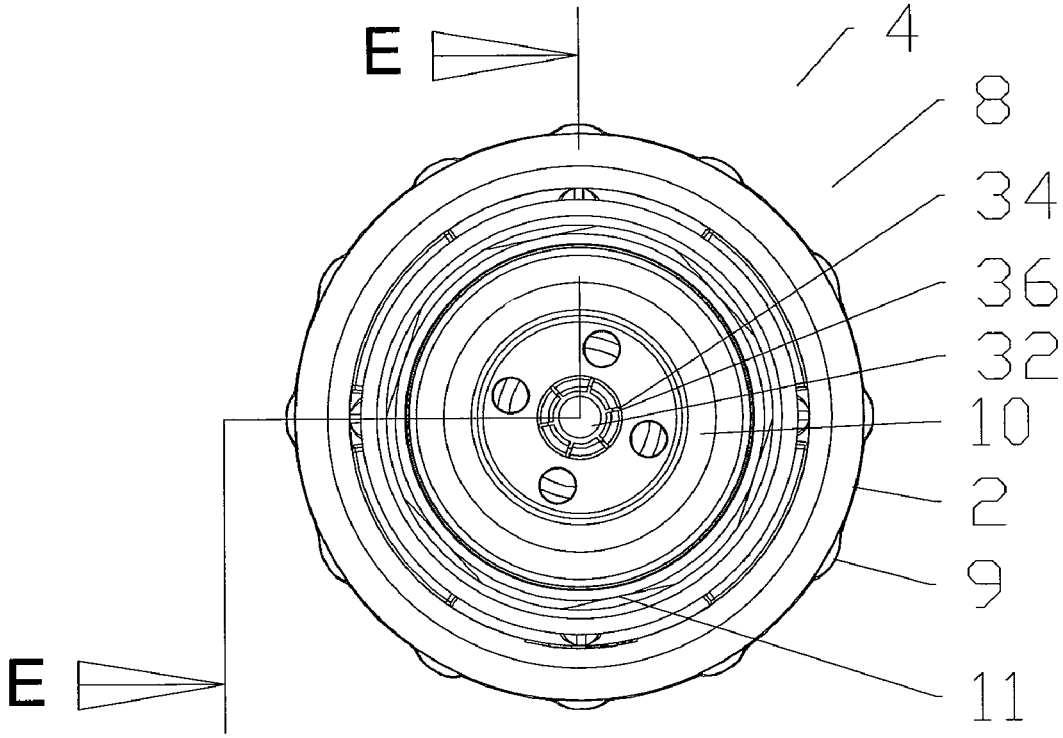
FIG. 3 is a schematic end view of the coaxial connector of FIG. 1.
Figure 7:
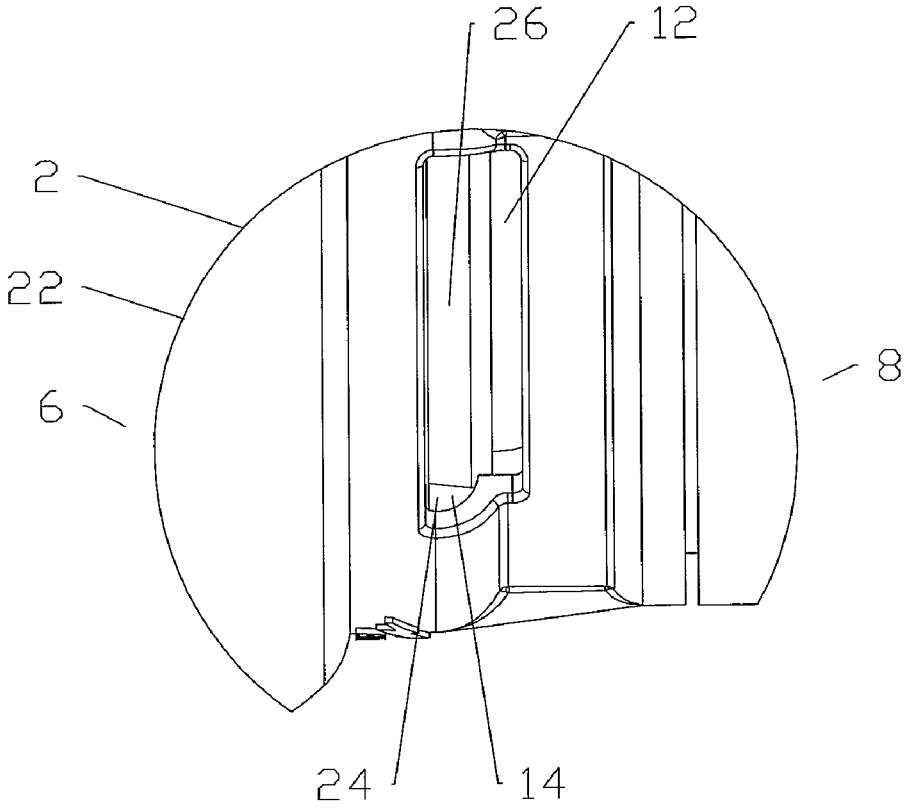
FIG. 7 is an enlarged view of area C of FIG. 6.
Figure 8:
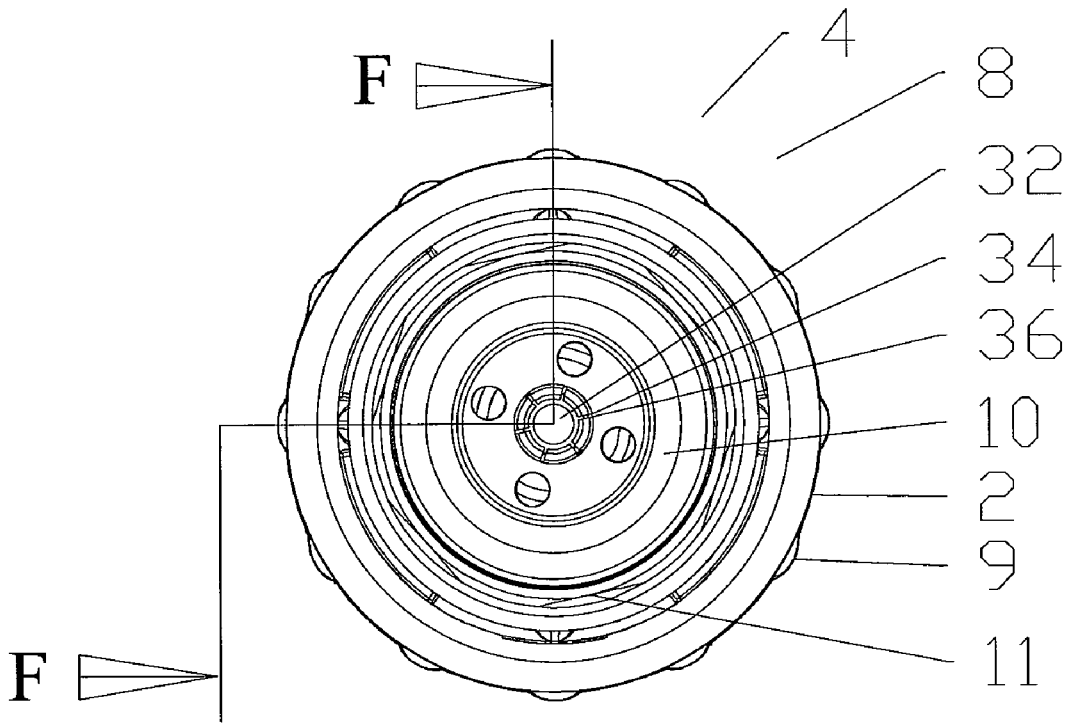
FIG. 8 is a schematic end view of the coaxial connector of FIG. 6.

As best shown in FIGS. 2 and 7, to provide visual installation feedback, the inner body 14 is formed of a transparent material, such as clear acrylic, polycarbonate, polystyrene or other polymer. The inner body 14 is dimensioned with a coupling body bore 20 dimensioned to receive the coaxial cable 7 therethrough. An outer surface 22 formed of opaque material partially covers the inner body 14, providing the coupling body 2 with a gripping surface. A portion of the inner body 14, corresponding to a prepared end of a coaxial cable 7 when inserted to a predetermined longitudinal position within the coupling body bore 20, is not covered by the outer surface 22, thereby forming a visual installation portal (VIP) 24. The VIP 24, preferably extending along an arc segment of the coupling body outer diameter circumference, allows the installer to observe the longitudinal position of the prepared end of the coaxial cable 7 within the coupling body bore 20. Visual indicia of the cable end position within the coupling body 2 is manifested by which portion(s) of the prepared end are visible through the VIP 24. For example, the end portion of the coaxial cable 7 is typically prepared for interconnection by stripping back designated portions of the dielectric, outer conductor and jacket to expose a portion of the outer conductor 12 and the inner conductor 32 to the coupling and/or sealing mechanisms of the coaxial connector. By locating the VIP 24 longitudinally along the coupling body 2 at a position which corresponds to the location of a selected portion of the cable end, such as the edge of the coaxial cable outer jacket 26, when the coaxial cable 7 is inserted to the desired depth within the coaxial connector 4 an easily observed good/bad indicia appears in the VIP 24 depending upon the good or bad insertion status of the coaxial cable 7 into the coaxial connector 4, that is, the proper or improper longitudinal insertion extent.

In the present embodiment, when the prepared end of the coaxial cable 7 has been seated within the coaxial connector 4, the installer should, for example, observe only an outer jacket 26 of the coaxial cable 7 and not the outer conductor 12 within the VIP 24. Because the outer jacket 26 is typically formed as a solid black polymeric material and the outer conductor 12 is typically shiny copper or aluminum metal, the visual distinction between these two materials within the VIP 24 is readily discernable. If the installer can see the outer conductor 12 through the VIP 24, a distinct visual feedback that the coaxial cable 7 may not be pushed far enough into the coaxial connector 4 is provided.

In further embodiments, the VIP 24 may be provided as multiple VIPs 24 to provide feedback both that insertion to a minimum desired position and less than an over-insertion position has been achieved. For example, a first uncovered portion operative as a minimum insertion indicating VIP 24 is applied as described herein above. Further, a second uncovered portion operative as an over-insertion VIP is applied spaced apart to the connector end side along the longitudinal axis to a location where the jacket 26 will not appear unless an over-insertion has occurred. At the proper insertion point, the first minimum insertion VIP 24 displays the jacket 26 when a coaxial cable 7 has been inserted into the coupling body bore 20, seating the coaxial cable 7 within the coaxial connector 4. Correspondingly, the over insertion VIP reveals an outer conductor 12 when the coaxial cable 7 has been inserted into the coupling body bore 20, seating the coaxial cable 7 within the coaxial connector 4. If the over-insertion VIP also shows the jacket 26, this is readily discernable visual indicia that an over-insertion installation error has occurred.

In a method for installing a coaxial cable 7 into the coaxial connector 4 of the first exemplary embodiment, the coaxial cable 7 may be inserted into the cable end 6 of the coupling body bore 20 until, for example, only the jacket 26 of the coaxial cable 7 can be seen through the VIP 24. Meanwhile, visibility of the outer conductor 12 in the VIP 24 alerts the installer that the coaxial cable 7 has not been inserted far enough into the coupling body bore 20.

Figure 5:
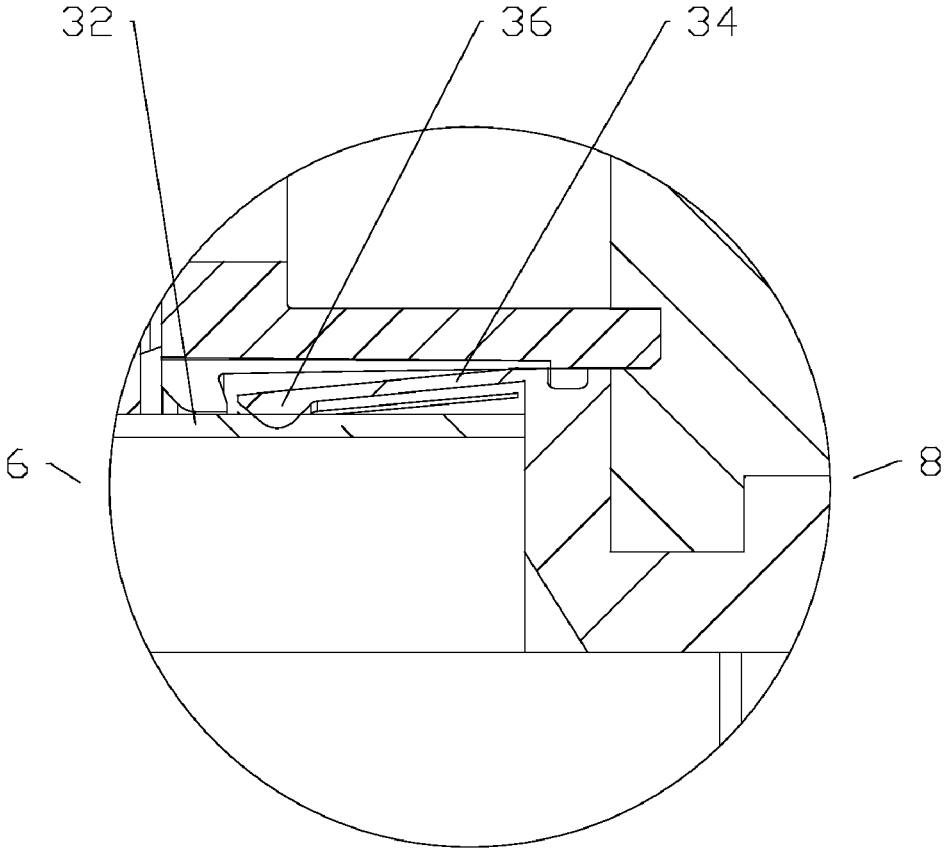
FIG. 5 is an enlarged view of area B of FIG. 4.
Figure 10:
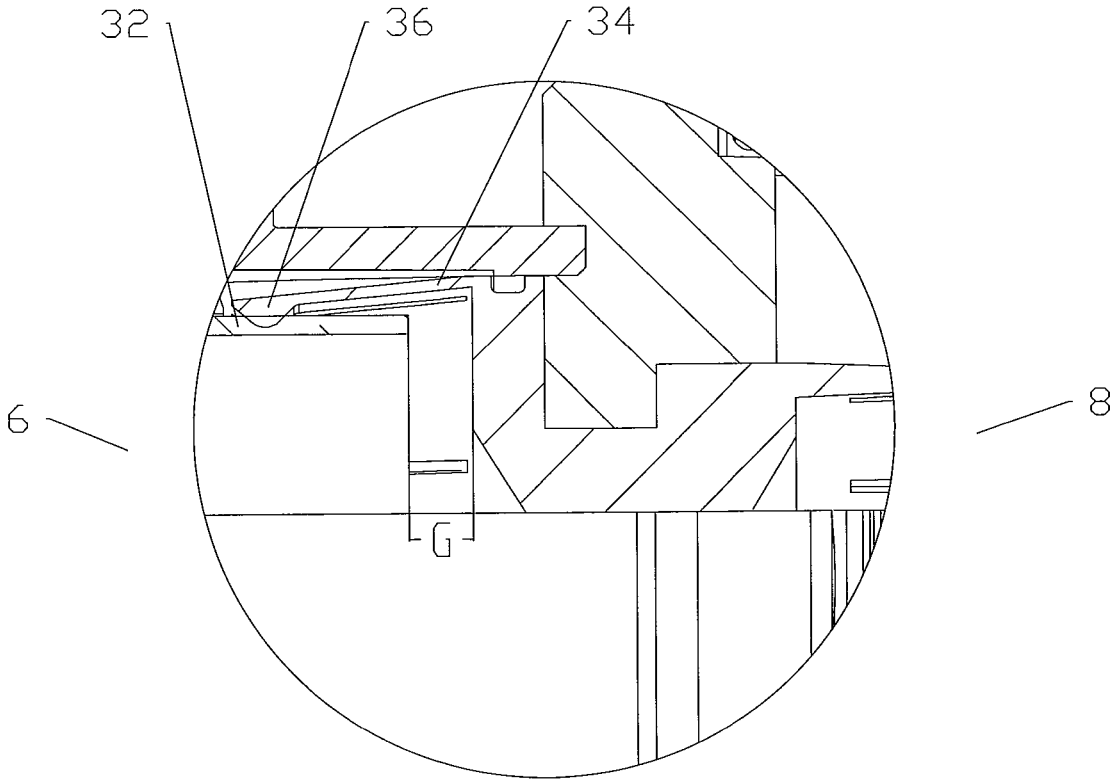
FIG. 10 is an enlarged view of area D of FIG. 9 with the bad installation resulting in gap G.

The jacket 26 will be visible through the VIP 24 when the desired insertion point has been reached, such as the inner conductor 32 of the coaxial cable 7 bottoming against a spring basket 36 of the inner contact 34, for example as shown in FIG. 5. If insertion to the proper insertion point has not been reached, a gap "G" will exist, as best shown in FIG. 10.

As a method for installing a coaxial cable 7 into a coaxial connector 4 according to the second exemplary embodiment, the coaxial cable 7 may be inserted into the coupling body bore 20 until the VIP 24 shows a jacket 26 and the over-insertion VIP reveals an outer conductor 12. Further, if the over-insertion VIP also shows the jacket 26, then an over-insertion error has occurred.

As best shown in FIGS. 4 and 9, where the outer conductor 12 is provided with annular corrugations, the corrugation peaks 38 may be keyed to their proper longitudinal location for interconnection when the coaxial cable 7 is properly inserted. Proper longitudinal location of internal contact points between the coaxial cable 7 and the electro-mechanical contacts of the coaxial connector 4 may be enabled by precision cutting the cable end, for example at a corrugation peak 38, for example using a sawguide/cable stripping tool configured to remove the desired lengths of the conductors, dielectric and jacket as a function of the position along the annular corrugations at which the cable end is cut. Thereby, for example, when the coaxial cable is properly inserted into the coaxial connector 4, as indicated in the VIP 24 and over-insertion VIP, if present, at least one corrugation peak 38 will have been brought into contact with a spring contact 40 and an inner diameter of a grip ring 42 is seated atop a corresponding corrugation peak 38.

One skilled in the art will appreciate that the present invention adds significant interconnection assurance at minimal additional manufacturing expense and without any degradation of either the overall strength or environmental integrity of the resulting coaxial connector 4. Further, the addition of the interconnection assurance provided by the invention may be applied to the coupling body 2 of an existing coaxial connector 4 configuration with minimal design revision as the modified portion of the connector body is outside of the coaxial connector 4 electrical path and/or attachment mechanisms of the coupling body 2.

Table of Parts

| | |
|---|---|
| 2 | coupling body |
| 4 | coaxial connector |
| 6 | cable end |
| 7 | coaxial cable |
| 8 | connector end |
| 9 | protrusion |
| 10 | connector body |
| 11 | tool flat |
| 12 | outer conductor |
| 14 | inner body |

-continued

| Table of Parts | |
|---|---|
| 16 | thread |
| 18 | connector body bore |
| 20 | coupling body bore |
| 22 | outer surface |
| 24 | visual installation portal |
| 26 | jacket |
| 32 | inner conductor |
| 34 | inner contact |
| 36 | spring basket |
| 38 | corrugation peak |
| 40 | spring contact |
| 42 | grip ring |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A method for installing a coaxial cable into an electrical connector, comprising the steps of:

inserting a prepared end of a coaxial cable into a cable end of an electrical connector with a coupling body;

the coupling body provided with a transparent inner body covered by an opaque material;

the inner body provided with a bore; and an uncovered portion of the inner body provided as a visual installation portal; and verifying that a desired portion of the prepared end can be seen through the visual installation portal.

2. The method of claim 1, wherein the desired portion is an outer jacket of the coaxial cable, visibility of the outer jacket of the coaxial cable indicating that an inner conductor of the coaxial cable has bottomed against the cable end of an inner contact within a spring basket of the inner contact.

3. The method of claim 1, wherein the desired portion is an outer jacket of a coaxial cable, visibility of the outer jacket of the coaxial cable indicating that at least one of a plurality of peaks of a corrugated outer conductor touches a spring contact of the coaxial connector and that a grip ring within a bore of the coaxial connector is seated on at least one of the peaks of the outer conductor.

4. The method of claim 1, further including the step of preparing the cable end by stripping back a desired length of an outer conductor and an outer jacket from the cable end.

5. The method of claim 4, wherein the preparing of the cable end is via a saw guide.

6. The method of claim 5, wherein the cable end is cut with respect to a longitudinal location, along a longitudinal axis of the coaxial cable, of a corrugation peak of an outer conductor of the coaxial cable.

7. The method of claim 6, wherein the coupling body is polymeric material.

* * * * *